United States Patent [19]

Ryan

[11] Patent Number: 4,784,612

[45] Date of Patent: Nov. 15, 1988

[54] ELECTRIC PLUG HOLDER

[76] Inventor: Allen H. Ryan, R.R. #1, Lombardy, Ontario, Canada, KOG 1LO

[21] Appl. No.: 82,166

[22] Filed: Aug. 6, 1987

[30] Foreign Application Priority Data

Sep. 2, 1986 [CA] Canada ..... 517316

[51] Int. Cl.[4] ..... H01R 13/639

[52] U.S. Cl. ..... 439/367; 439/369

[58] Field of Search ..... 439/367, 369–371, 439/373

[56] References Cited

U.S. PATENT DOCUMENTS

| | | | |
|---|---|---|---|
| 2,037,907 | 4/1936 | Johnson | 439/367 |
| 2,240,050 | 4/1941 | Nuebling | 439/367 |
| 3,281,755 | 10/1966 | Trager | 439/367 |
| 3,383,639 | 5/1968 | Anderson et al. | 339/75 |
| 3,654,588 | 4/1972 | Ruth | 439/367 |
| 4,643,505 | 2/1987 | House et al. | 339/75 P |

FOREIGN PATENT DOCUMENTS 1166736 5/1984 Canada .

*Primary Examiner*—John McQuade

*Attorney, Agent, or Firm*—Neuman, Williams, Anderson & Olson

[57] ABSTRACT

A device for holding together a male plug and a female plug of an electrical connector in a connected state, each of the male and female plugs having an electrical cord extending therefrom, comprises a pair of hollow members each capable of accommodating a plug. The members each have an open end through which a plug can be accessed, and a substantially closed end, with a slot extending from the closed end to the open end, through which slot the electrical cord can be passed. The hollow members are adapted to be joined together by complementary helix threads of a sufficient large dimension to maintain the male and female members in their connected state.

8 Claims, 1 Drawing Sheet

ELECTRIC PLUG HOLDER

The present invention relates to the field of electric plug coupling devices.

When using electrical devices such as power tools or electric lawn mowers, a commonly encountered problem is accidental uncoupling of the device's cord from an extension cord, or accidental uncoupling of two extension cords. This is both an annoyance and a potential safety hazard, especially if the prongs from the male plug of one cord come half way out of the female plug of another, thereby exposing an electrically live surface.

To keep a pair of extension cords connected, individuals often tie the cords together near their ends, and then plug them together. While this will generally keep the cords together, it shortens the effective length of the cords, and creates a different safety hazard: a large knot which can unexpectedly catch on a work-piece, bush, rock or other object, sometimes with disasterous results.

Several extension cord plug coupling devices have been proposed. For instance, U.S. Pat. No. 3,383,639, dated May 14, 1968, to Anderson et al shows a cord coupling clamp which will do an effective job in holding a pair of plugs together. The Anderson clamp comprises a pair of complementary members made of sheet materials, each member having a base flange, a clamping flange and a terminal retainer flange. The base flanges are held together by a bolt which projects outwardly therefrom, and one of the base flanges is slotted, so that the two can be locked together with the clamping flanges thereof in a closed-together or spread-apart position. Each clamping flange and terminal flange is slotted to accept an extension cord. As stated previously, this device does a good job of keeping a pair of plugs together. However, it has disadvantages. In particular, it presents several parts (such as terminal flanges, or the outwardly projecting bolt) which can easily catch on a workpiece, bush, or the like.

Another proposed device is described in Canadian Pat. No. 1,166,736, granted May 1, 1984, inventors House et al, for an extension cord connector housing. This is a one piece closable housing, with a longitudinally extending hinge connecting together the upper and lower halves of the housing. The housing halves have laterally ribbed interiors. A pair of slotted circular members can be placed between pairs of ribs in the lower half of the housing, at a desired spacing, to accept within their slots a plugged-together set of extension cord plugs, and then the housing is closed, and the ribs on the upper half of the housing engage the slotted members, thereby to keep the plugs together. This device is fairly streamlined, so it is not likely to catch on things like bushes. However, it is dependant, for its effectiveness, on the two slotted members noted above, each of which is about the size of a large coin, and therefore could be lost if care is not taken when the device is opened to permit unplugging of the extension cord.

The object of the present invention is to provide a simple and inexpensive device for securing together a pair of electrical plugs, and to overcome the disadvantages associated with known devices of this type.

In one broad aspect, the present invention relates to a device for holding together a male plug and a female plug of an electrical connector in a connected state, each of the male and female plugs having an electrical cord extending therefrom, comprising: male and female members of substantially cylindrical hollow configuration and adapted to accommodate one of the male or female plugs of the electrical connector, each member made of a plastic material and having a circular open end through which an accommodated plug can be accessed, and a closed end of substantially hemispherical configuration; wherein each member has a slot extending from the closed end to the open end, through which slot the electrical cord of the accommodated plug can be passed; wherein the male member has an exterior surface, adjacent its open end and presenting a first helix thread; wherein the female hollow member has an interior surface, adjacent its open end and presenting a second helix thread complimentary to the first helix thread for receiving said first helix thread, whereby the male and female members and their accommodated plugs are maintained in the connected state; and wherein the first and second helix threads are of a sufficiently large dimension to prevent the disengagement thereof and the resultant separation of the male and female members.

In the drawings which, by way of example, illustrate the present invention:

Figure 1:
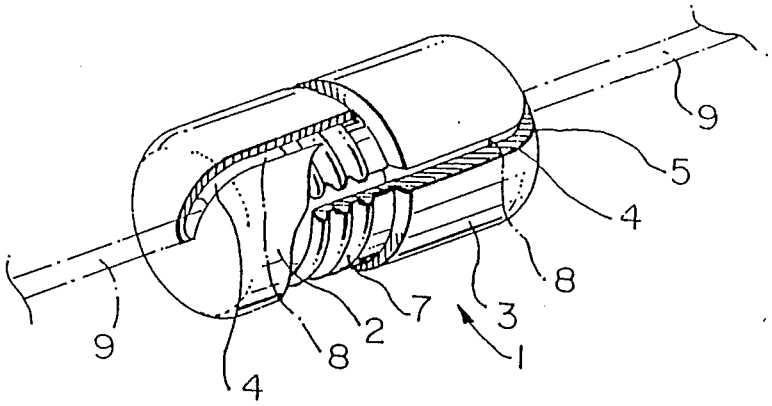
FIG. 1 is a perspective view of a preferred embodiment of the present invention.
Figure 2:
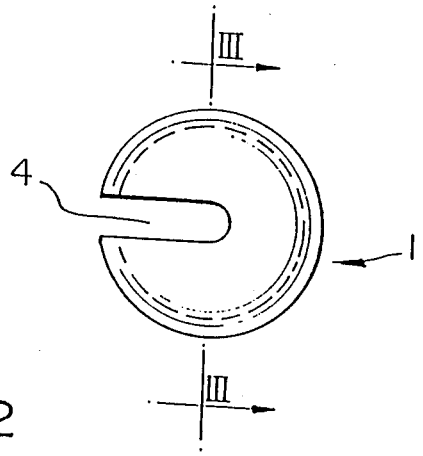
FIG. 2 is an end view of the embodiment of FIG. 1.
Figure 3:
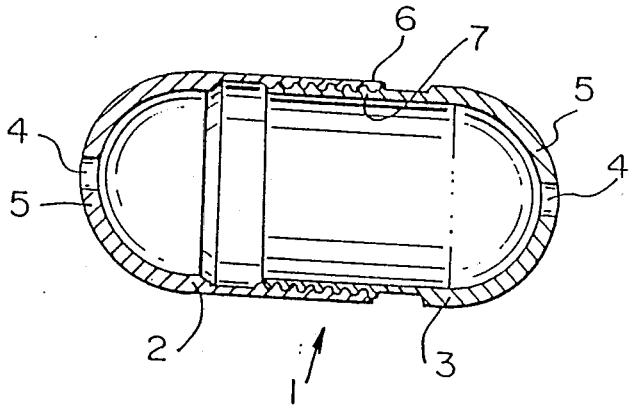
FIG. 3 is a cross-sectional view along line III—III in FIG. 2.

Referring to the drawings, the present invention comprises a hollow capsule, indicated generally at 1, with a female half 2 and a male half 3.

Each of the two halves 2 and 3 is provided with a longitudinally extending slot 4 which extends the length of the respective female 2 or male 3 half, and mid-way down the width thereof. Each half 2 and 3 is large enough to accommodate an extension cord plug 8 in its interior. Each half 2 and 3 has a rounded substantially hemispherical end 5 in the embodiment illustrated, but the end may be substantially conical or otherwise streamlined, so that the capsule 1 will not catch on bushes, or the like.

The exterior surface of the male half 3 is provided with a helical screw thread 7, which may be a one start, two start, three start, four start (or even more) thread. That is, the thread may be a single helix, or a double, or triple (and so on) helix. The female half 2 of the capsule 1 is provided with a corresponding tapped interior surface 6, engageable with thread 7. The thread 7 should be made sufficiently wide and deep that cross-threading is substantially eliminated. Moreover, with a wide, deep thread, the female 2 and male 3 halves will remain joined together, even if the male half 3 is jarred and spread open slightly, which may happen, because of the existence of slot 4. In a preferred embodiment, a $\frac{1}{8}$ inch thread is employed, with good results.

To use the present invention, the two halves 2 and 3 of the capsule are screwed apart, and each half is inserted, via slot 4 over an extension cord 9, near the plug end thereof, with the open end of the capsule pointing toward the plug. The plugs are then plugged together (they may be plugged together before application of the capsule, the order here makes no difference), and female half 2 is screwed into male half 3. The two halves will screw together until the interior surfaces of the ends 5 contact the plugs and then a slight tightening of the male half into the female half will cause a snug frictional fit of the capsule halves against the plugs, thereby securing the capsule halves together.

The capsule halves are preferrably manufactured from a plastic material, such as polyethylene, which can be injection moulded. Suitable materials will be obvious to the prospective manufacturer of the present invention.

It will be understood that the foregoing description is not meant to limit the scope of the present invention. Once the present invention is appreciated and understood other method and means of fastening the capsule halves together will be apparent.

I claim:

1. A device for holding together a male plug and a female plug of an electrical connector in a connected state, each of the male and female plugs having an electrical cord extending therefrom, said device comprising:

male and female members of substantially cylindrical hollow configuration, each of said members adapted to accommodate one of the male or female plugs of the electrical connector, each of said members made of a flexible material and having a circular open end through which its accommodated plug can be accessed, and a shaped closed end of substantially uniform thickness and hemispherical configuration;

each of said members having a slot extending from said closed end to said open end, for receiving the electrical cord of its accommodated plug;

said male hollow member having an exterior surface, adjacent its open end, and presenting a first helix screw thread; and said female hollow member having an interior surface, adjacent its open end, and presenting a second helix thread complimentary to said first helix thread for receiving said first helix thread, whereby said male and female members and their accommodated plugs are maintained in said connected state, said first and second helix threads being of a sufficiently large dimension to prevent the disengagement thereof and the resultant separation of said male and female members.

2. The device claimed in claim 1, wherein said slot of each of said members is of a width selected to permit the electrical cord of said member to pass therethrough and to retain its plug therein, and extends from a center of said closed end along the length of said member to its open end.

3. The device as claimed in claim 2, wherein each of the electrical cords has an outer dimension, each of said slot widths of said male and female members is set substantially equal to said outer dimension, each of said slots terminating at said center, and each of said slot terminations being of a configuration conforming to that of the electrical cord, whereby the electrical cord is restrained from movement with respect to its member.

4. The device as claimed in claim 1, wherein said first and second helix threads are of at least a double helical configuration.

5. The device as claimed in claim 1, wherein said interior surface of said female member is tapped at its open end to accept said first helix thread of said male member.

6. The device as claimed in claim 1, wherein each of said members is made of a plastic material.

7. The device as claimed in claim 6, wherein said plastic material is polyethylene.

8. The device as claimed in claim 2, wherein said dimension of said first and second helixes is one-eight inch

* * * * *